US009386847B1

(12) United States Patent
Jeffries

(10) Patent No.: US 9,386,847 B1
(45) Date of Patent: Jul. 12, 2016

(54) MOUNTING SYSTEM

(71) Applicant: Austin Hardware & Supply, Inc., Lee's Summit, MO (US)

(72) Inventor: Mark Steven Jeffries, Buford, GA (US)

(73) Assignee: AUSTIN HARDWARE AND SUPPLY, INC., Lee's Summit, MO (US)

( * ) Notice: Subject to any disclaimer, the term of this patent is extended or adjusted under 35 U.S.C. 154(b) by 0 days.

(21) Appl. No.: 14/800,936

(22) Filed: Jul. 16, 2015

Related U.S. Application Data

(60) Provisional application No. 62/025,731, filed on Jul. 17, 2014.

(51) Int. Cl.

| | |
|---|---|
| ***A47B 57/10*** | (2006.01) |
| ***A47B 47/00*** | (2006.01) |
| ***A47B 57/22*** | (2006.01) |
| ***A47B 57/40*** | (2006.01) |
| ***A47B 96/02*** | (2006.01) |
| ***A47B 96/06*** | (2006.01) |
| ***A47B 96/14*** | (2006.01) |

(52) U.S. Cl.

CPC ..... *A47B 57/10* (2013.01); *A47B 47/005* (2013.01); *A47B 47/0091* (2013.01); *A47B 57/22* (2013.01); *A47B 57/40* (2013.01); *A47B 96/024* (2013.01); *A47B 96/025* (2013.01); *A47B 96/06* (2013.01); *A47B 96/1416* (2013.01)

(58) Field of Classification Search

CPC ..... A47B 57/10; A47B 57/40; A47B 57/22; A47B 96/06; A47B 96/025; A47B 96/024; A47B 96/1416; A47B 47/0091; A47B 47/005

USPC ..... 211/88.01, 90.02, 126.15, 187, 190, 211/208

See application file for complete search history.

(56) References Cited

U.S. PATENT DOCUMENTS

| | | | | | |
|---|---|---|---|---|---|
| 2,895,620 | A * | 7/1959 | Thompson | A47B 47/02 | 108/107 |
| 2,995,257 | A * | 8/1961 | Anka | A47B 31/00 | 211/208 |
| 3,347,187 | A * | 10/1967 | Khoury | A47B 57/10 | 108/108 |
| 3,355,231 | A * | 11/1967 | Kegel | A47B 88/20 | 211/126.15 |
| 4,022,517 | A * | 5/1977 | Eckert | A47F 3/00 | 312/107 |
| 5,595,127 | A * | 1/1997 | Eustace | A47B 47/025 | 108/109 |
| 5,797,502 | A * | 8/1998 | Brady | A47F 1/12 | 108/107 |
| 6,644,481 | B2 * | 11/2003 | Dean | H05K 7/1489 | 211/190 |
| 6,930,886 | B2 * | 8/2005 | Velez | H05K 7/1489 | 211/187 |
| 7,284,672 | B2 * | 10/2007 | Tsai | A47B 88/044 | 211/192 |
| 7,520,576 | B2 * | 4/2009 | Ludwig | E05B 65/464 | 312/217 |
| 8,172,344 | B2 * | 5/2012 | Eyer | A47B 96/00 | 108/107 |
| 9,109,804 | B2 * | 8/2015 | Armstrong | F24C 15/16 | |
| 2006/0125357 | A1 * | 6/2006 | Ludwig | E05B 65/464 | 312/221 |
| 2006/0254996 | A1 * | 11/2006 | McAfee | A47B 57/10 | 211/90.02 |
| 2010/0253196 | A1 * | 10/2010 | Nye | A47B 47/042 | 312/352 |
| 2013/0213918 | A1 * | 8/2013 | Doyle, Jr. | F16M 11/00 | 211/187 |
| 2014/0238383 | A1 * | 8/2014 | Armstrong | F24C 15/16 | 126/337 A |

* cited by examiner

*Primary Examiner* — Brent W Herring

(74) *Attorney, Agent, or Firm* — Polsinelli PC

(57) ABSTRACT

A mounting system is described that may be used to removably and adjustably engage or affix shelves, bins, drawers, drawer-slides, etc. to shelving systems, cabinets, closets, walls, etc. The mounting system includes supports, which define engaging openings. The shelves, bins, drawers, drawer-slides, etc. are fitted with studs that secure to the engaging openings to hold the shelves, bins, drawers, drawer-slides, etc. in place with respect to the supports.

20 Claims, 13 Drawing Sheets

FIG. 29
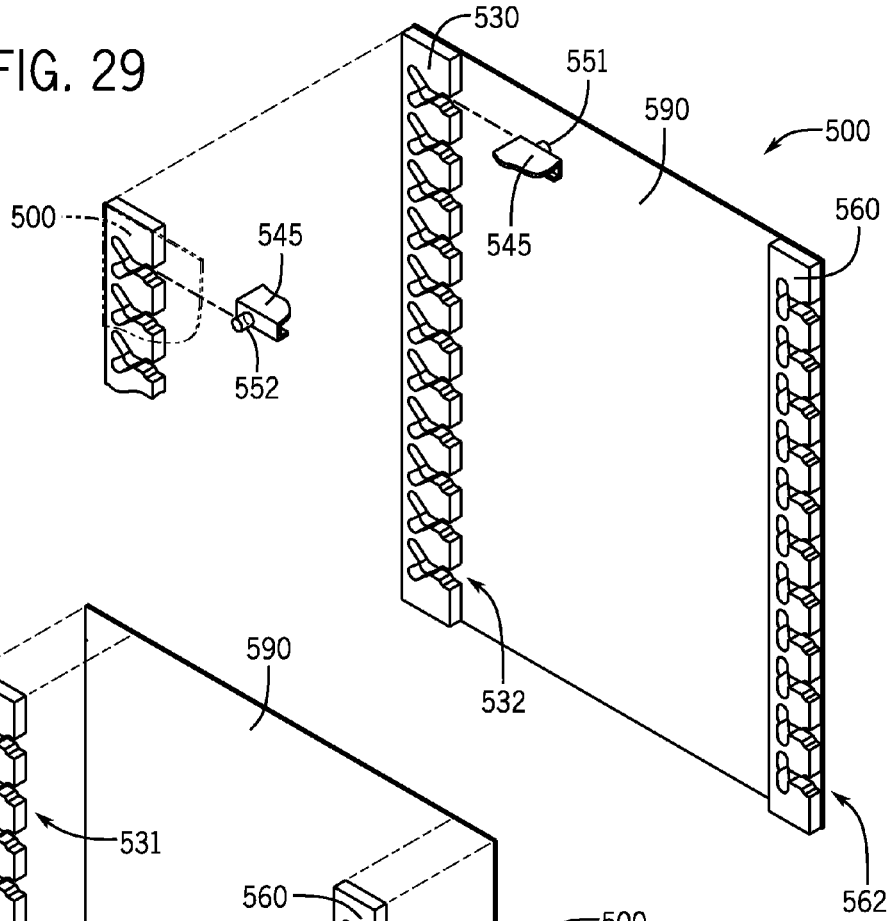
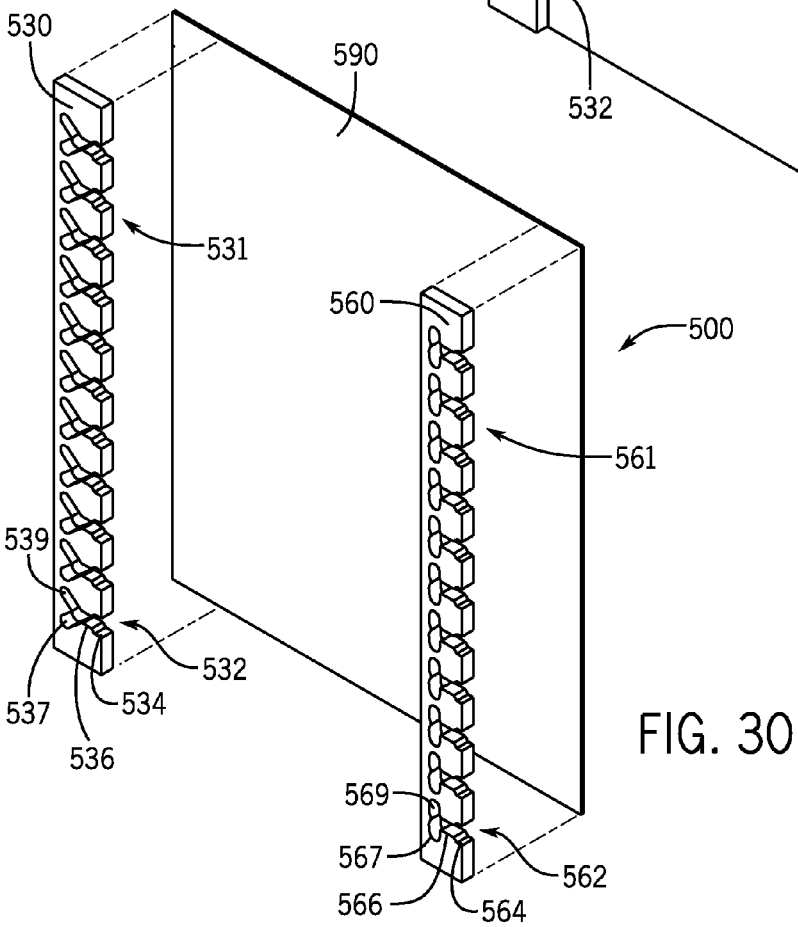
FIG. 30

MOUNTING SYSTEM

CROSS REFERENCE TO RELATED APPLICATION

This application claims the benefit of U.S. Provisional Patent Application No. 62/025,731, filed Jul. 17, 2014, which is hereby incorporated by reference.

FIELD OF INVENTION

The present invention relates to a mounting system that may be used to mount shelves, bins, drawers, drawer-slides, hangers, brackets, etc. to shelving systems, cabinets, closets, walls, etc.

BACKGROUND

Many prior shelving and cabinet systems suffer from a lack of adjustability. Prior shelving and cabinet systems that are adjustable often suffer from components that are tedious, complex, or difficult to adjust or remove.

SUMMARY

The mounting system may be used to removably and adjustably engage or affix shelves, bins, drawers, drawer-slides, hangers, brackets, etc. to shelving systems, cabinets, closets, walls, etc. The mounting system allows the user to easily remove the shelves, bins, drawers, drawer-slides, hangers, brackets, etc. from the shelving systems, cabinets, closets, walls, etc. and to move the shelves, bins, drawers, drawer-slides, hangers, brackets, etc. to different positions in the shelving systems cabinets, closets, walls, etc.

The mounting system provides for near limitless adjustment of shelves, bins, drawers, etc. The shelves, bins, drawers, etc. may be removed from the mounting system and re-installed in the mounting system in different positions. The shelves may be removed and replaced with drawers and the like. The mounting system provides for a user to customize their storage system by adjusting, moving, and/or replacing the shelves, bins, drawers, etc. As storage needs change, the mounting system may be adjusted to best suit the user.

The mounting system includes supports, which define engaging openings. The shelves, bins, drawers, drawer-slides, etc. are fitted with studs that secure to the engaging openings to hold the shelves, bins, drawers, drawer-slides, etc. in place with respect to the supports. The studs are locked in place with respect to the supports. Once locked in the place, the studs cannot move in any angle of direction or orientation.

The supports may include universal panels with an integral front and rear supports. In this context, the term "universal" provides for the panels or supports to be used on either the right or left sides of the cabinet, drawer, shelving unit, etc. The supports may include separate universal front supports and universal rear supports. The supports may also include right side panels with integral front and rear supports. The supports may also include left side panels with integral front and rear supports. The supports may also include separate right-front, right-rear, left-front, and left-rear supports.

The engaging opening receives the studs to lock, seat, or otherwise engage the studs to hold the studs in position with respect to the supports. The studs engage the supports to hold the shelves, bins, drawers, drawer-slides, etc. The studs may be removed from the engaging openings by a simple upward lifting and sliding outward movement.

The engaging openings include an entry opening that receives the stud. The engaging openings further include channels connected to the entry openings. From the entry openings, the studs may slide or move against the channels. The channels retain the studs in a sliding, yet secure engagement.

The shape and orientation of the engaging openings will vary depending on the location of the mounting system with respect to the cabinet, drawer, shelving unit, etc. Front engaging openings generally have a vertical orientation with a downward path, while rear engaging openings generally have an angled path away from the vertical orientation of the front engaging openings.

With respect to a universal front support, the engaging openings include an entry opening leading to a central channel. The central channel leads to a lower channel and an upper channel. The lower channel and the upper channel are generally perpendicular to the central channel. The engaging openings may have an approximate "t" shape. Depending on the orientation of the installation of the universal front support (either on the left side or the right side), the studs will seat in either the lower channel or in the upper channel.

With respect to a universal rear support, the engaging openings include an entry opening leading to a central channel. The central channel leads to a lower channel and an upper channel. The lower channel and the upper channel angle away from the central channel, i.e., toward the rear of the universal rear support. Depending on the orientation of the installation of the universal rear support (either on the left side or the right side), the stud will seat in either the lower channel or the upper channel. For example, a stud may enter the lower channel of the universal support when the universal stud is installed on the left side. However, when that same universal support is flipped over and installed on the right side, another stud may enter the upper channel (which is now in the lower position).

The lower channel and the upper channel of the universal rear support angle away from the central channel. In some aspects, the upper channel angles away from the central channel at an approximately positive 45 degree angle (i.e. upwards and rearward), and the lower channel angles away from the central channel at an approximately negative 45 degree angle (i.e. downward and rearward).

A widened portion or head of the stud may be contained by a first side of the supports. An extending portion of the studs may pass through the channels and/or rest on a rim of the channels. The extending portion may pass to a second side of the supports. The extending portion is affixed or attaches to the shelves, bins, drawers, drawer-slides, etc. The supports may contain the widened portion of the stud in a sliding or movable engagement. The widened portion of the studs may move against or near inner walls of the supports as the shelves, bins, drawers, drawer-slides, etc. are installed to the supports.

In one aspect, an adjustable mounting system is described. The adjustable mounting system includes a left front support including a forward entry opening leading to a first forward channel. The first forward channel leads to a first forward lower channel and a first forward upper channel. The first forward lower channel and the first forward upper channel have a generally vertical orientation. The adjustable mounting system includes a left rear support including a first rear entry opening leading to a first rear channel. The first rear channel leads to a first rear lower channel and a first rear upper channel. The first rear lower channel and the first rear upper channel have an angled orientation. The adjustable mounting system includes a right front support including a second forward entry opening leading to a second forward channel. The second forward channel leads to a second forward upper channel and a second lower channel. The second forward upper channel and the second forward lower channel have a generally vertical orientation. The adjustable mounting system includes a right rear support including a second rear entry opening leading to a second rear channel. The second rear channel leads to a second rear lower channel and a second rear upper channel. The second rear lower channel and the second rear upper channel have an angled orientation. A first stud enters the first forward entry opening. A second stud enters the first rear entry opening. A third stud enters the second forward entry opening. A fourth stud enters the second rear entry opening. The first stud seats in the first forward lower channel. The second stud seats in the first rear lower channel. The third stud seats in the second forward lower channel. The fourth stud seats in the second rear lower channel.

The position of the studs and the angles of the channels maintain the studs seated in ends of their respective channels. The distance between the studs on the same side of the drawer or shelf is approximately the same as the distance between the ends of the channels that are receiving the studs. This spatial relationship locks the studs in the ends. Once the studs are seated in the ends of the forward lower channels and the studs are seated in the ends of the rear lower channels, the shelf is essentially locked in place. The forward studs cannot move laterally due to a vertical orientation of walls of the forward lower channels. The rear studs cannot move laterally or vertically due to walls of the rear lower channels. The weight of the shelf will generally hold the shelf in place. One or more plugs may further block or lock one or more of the studs in place to prevent any movement by the shelf. For example, the plugs may block the upward movement of the forward studs.

Although the mounting system is described with reference to shelving systems, cabinets, closets, walls, etc. the mounting system may be used to removably and adjustably engage or affix therapeutic or exercise equipment to walls or other substrates. The mounting system may be used to removably and adjustably engage all types of articles, such as handles, brackets, pulls, etc. to walls or other substrates. The mounting system may provide a hanging system for hangers, cantilevered shelves, etc. for use in garages, closets, storage areas, etc.

BRIEF DESCRIPTION OF DRAWINGS

FIG. 29 is a perspective view of a universal panel with solid supports.

FIG. 30 is a perspective view of the universal panel with the sold supports attaching to a backing.

DETAILED DESCRIPTION OF INVENTION

Figure 1:
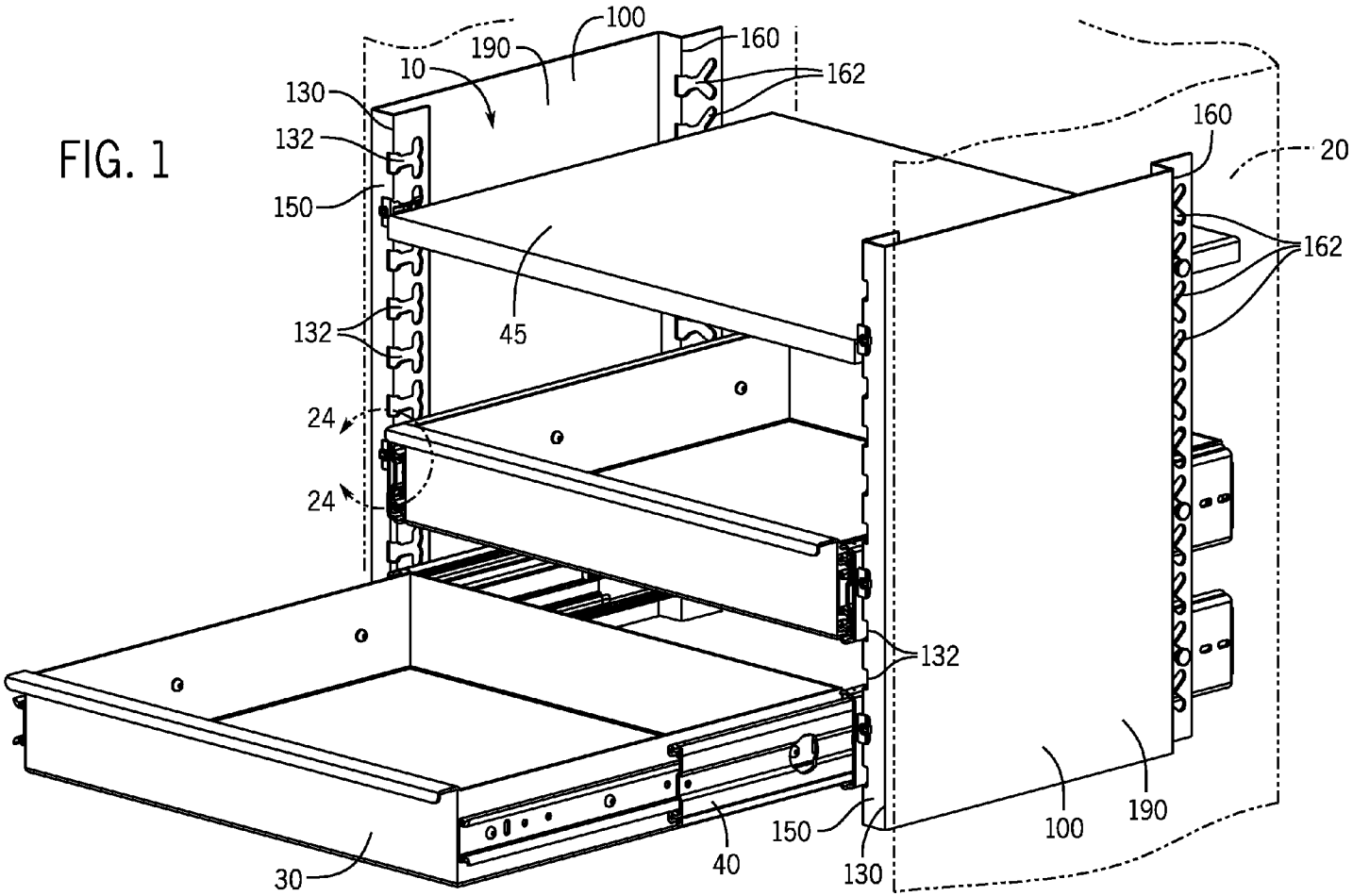
FIG. 1 is a view of the mounting system installed in the cabinet.

A mounting system 10 will now be described with reference to FIGS. 1-30. A cabinet 20 is shown which includes drawers 30, drawer slides 40, and a shelf 45. Any combination of the drawers 30, drawer slides 40, and shelves 45 may be used with the cabinet 20. The mounting system 10 removably and adjustably engages the drawers 30, drawer slides 40, and the shelf 45 to the cabinet 20. Additional drawers 30, drawer slides 40, and shelves 45 may also be engaged to the cabinet 20. Other racks, bins, trays, etc. may also utilize the mounting system 10.

Figure 3:
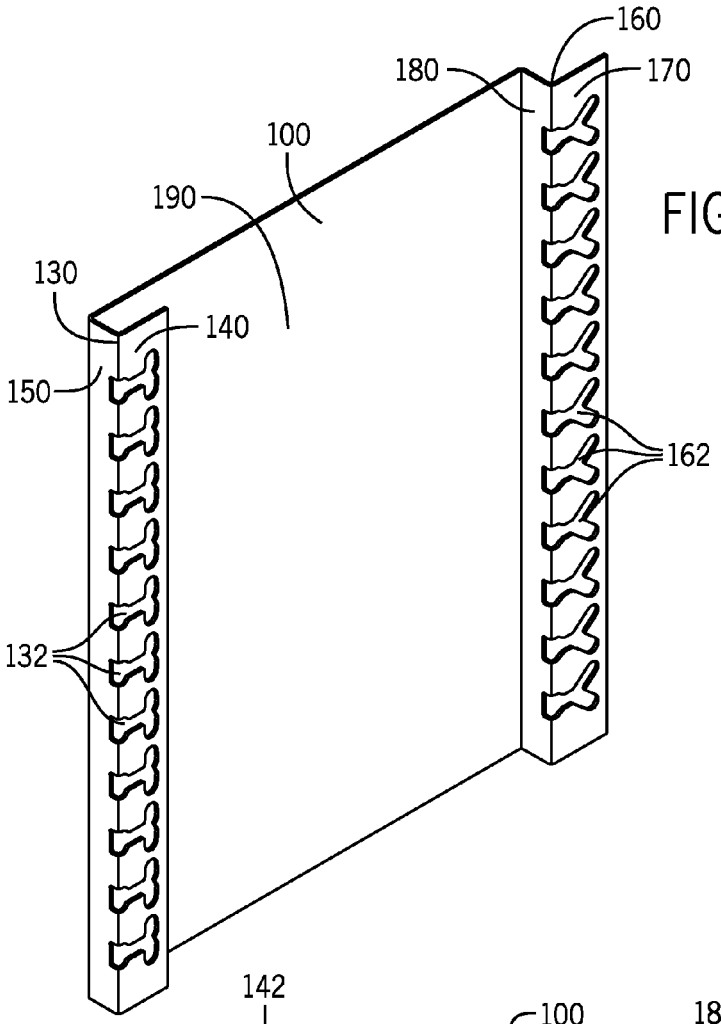
FIG. 3 is a perspective view of the universal panel.
Figure 4:
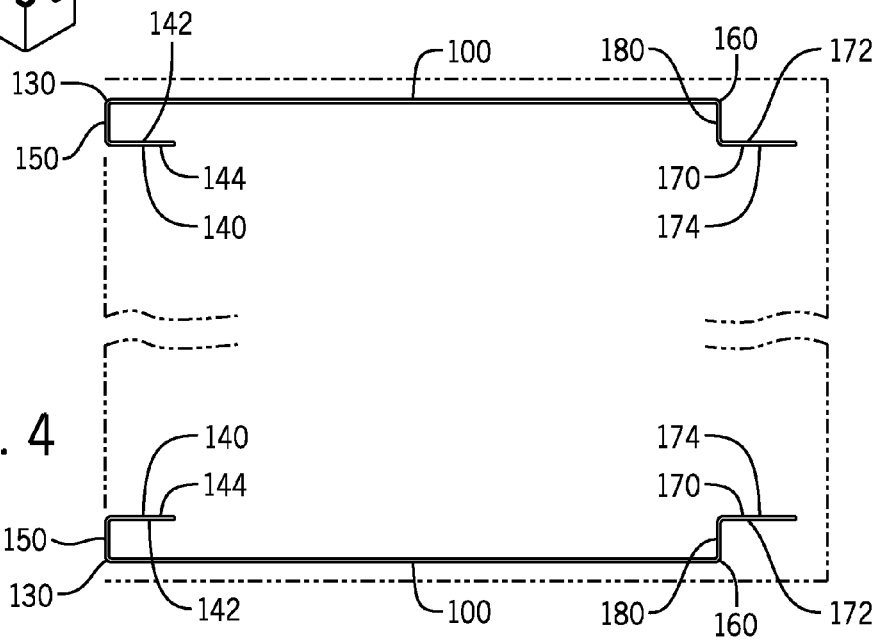
FIG. 4 is a top-down view of the universal panels installed in the cabinet.

A universal panel 100 is shown in FIG. 3. The universal panel 100 may be installed on both a left side and a right side of the drawers 30, drawer slides 40, and shelves 45. For example, one piece of the universal panel 100 may be cut into multiple pieces that provide left side and right side holding structures for the drawers 30, drawer slides 40, and shelves 45. The universal panel 100 may be provided in extended heights that are cut to fit specific or custom cabinets and shelving applications. The universal panel 100 may also be provided in standard lengths that are sized to fit standard shelving and cabinet applications. For example, the universal panel 100 may be provided in common heights of 4, 6, or 8 feet. Of course, any specific heights of the universal panel 100 may be provided.

The universal panel 100 includes a front support 130 and a rear support 160 integrally joined by a backing 190. The backing 190 spans a distance between the front support 130 and the rear support 160. The backing 190 may be mounted to the cabinet 20, walls, or other structures. The front support 130 includes forward engaging openings 132. The rear support 160 includes rear engaging openings 162. The engaging openings 132 and 162 receive studs 51, 52, 53, and 54, which are attached to any of the drawers 30, drawer slides 40, and shelves 45. The studs 51-54 removably engage to the engaging openings 132 and 162.

Figure 5A:
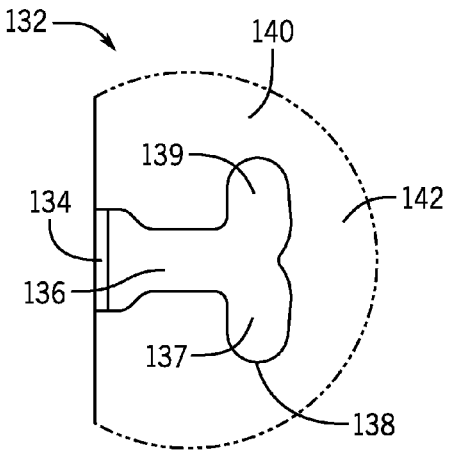
FIG. 5A is a view of the forward engaging openings.

The front support 130 is an elongate member with a forward side wall 140 and a front wall 150. A plurality of forward engaging openings 132 are spaced along the length of the front support 130. With reference to FIG. 5A, the forward engaging openings 132 include a forward entry opening 134 leading to a forward channel 136, which leads to a forward lower channel 137 and a forward upper channel 139. The forward entry opening 134 may pass through the front wall 150. The forward channel 136, the forward lower channel 137, and the forward upper channel 139 may pass through the forward side wall 140. The forward channel 136 provides a central channel that forks or splits into the forward lower channel 137 and the forward upper channel 139.

The forward lower channel 137 may be generally perpendicular to the forward channel 136, and the forward upper channel 139 may be generally perpendicular to the forward channel 136.

The forward side wall 140 includes an inner surface 142 and an outer surface 144. The forward side wall 140 is generally perpendicular to the front wall 150. This provides a space in or behind the front support 130 for the studs 51 and 53 to move or slide. The forward entry openings 134 pass through the front wall 150. The forward entry openings 134 may be integral with the forward channel 136. The forward entry openings 134 in the front wall 150 may directly lead into the forward channel 136, the forward lower channel 137, and the forward upper channel 139 in the forward side wall 140.

Figure 5B:
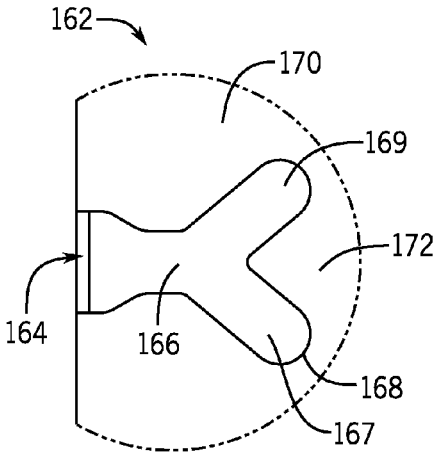
FIG. 5B is a view of the rear engaging openings.
Figure 6:
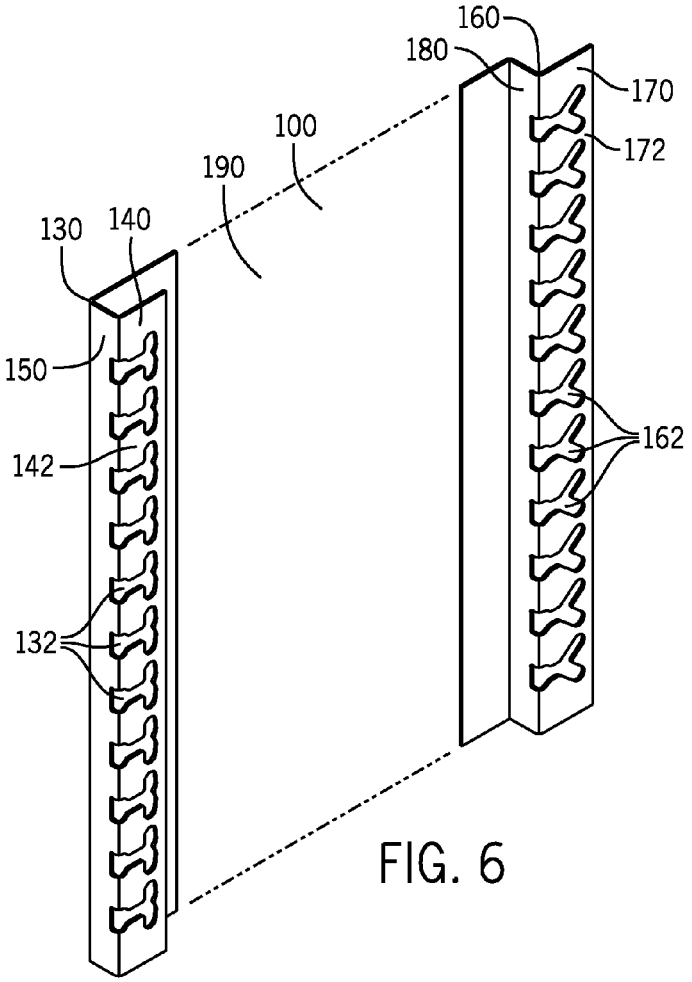
FIG. 6 is a perspective view of the front support and the rear support.
Figure 7:
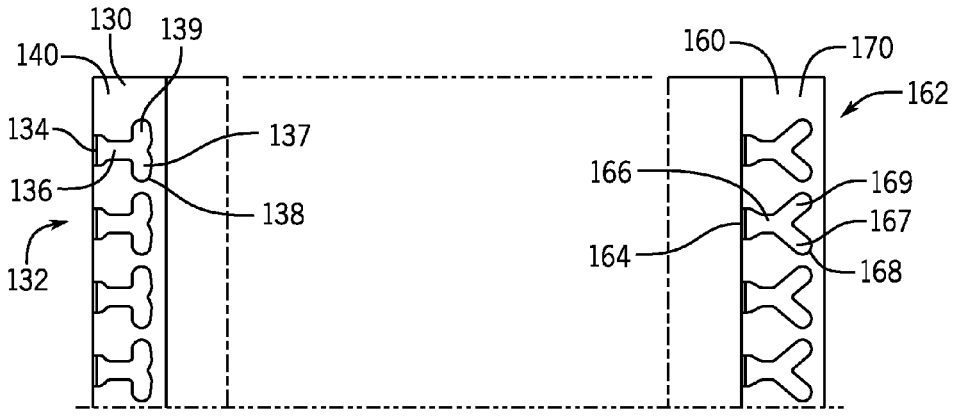
FIG. 7 is a side view of the universal front support and the universal rear support.

The rear support 160 includes an elongate member with a rear side wall 170 and rear wall 180. A plurality of rear engaging openings 162 are spaced along a length of the rear support 160. With reference to FIG. 5B, the rear engaging openings 162 include a rear entry opening 164 leading to a rear channel 166, which leads to a rear lower channel 167 and a rear upper channel 169. The rear channel 166, the rear lower channel 167, and the rear upper channel 169 pass through the rear side wall 180.

The rear side wall 180 includes an inner surface 172 and an outer surface 174. The rear side wall 180 is generally perpendicular to the rear wall 170. This provides a space in or behind the rear support 160 for the studs 52 and 54 to slide or move. The rear entry openings 164 pass through the rear wall 170. The rear entry openings 164 may be integral with the rear channel 166. The rear entry openings 164 in the rear wall 170 may directly lead into the rear channel 166, the rear lower channel 167, and the rear upper channel 169. The rear channel 166 provides a central channel that forks or splits into the rear lower channel 167 and the rear upper channel 169.

The rear lower channel angles 167 away from the rear channel 166, and the rear upper channel 169 angles away from the rear channel 166. For example, the rear lower channel 167 may angle downward and away from the rear channel 166 at an approximately negative 45 degree angle, and the rear upper channel 169 may angle upward and away from the rear channel 166 at an approximately positive 45 degree angle.

The forward entry openings 134 and the rear entry openings 164 generally have a larger or greater dimension than the remainder of the channels 136, 137, 139, 166, 167, 169, respectively. As described below, this provides for the studs 51, 52, 53, 54 to enter the forward entry openings 134 and the rear entry openings 164 and be contained, retained, or otherwise held by the channels 136, 137, 139, 166, 167, 169.

Figure 12A:
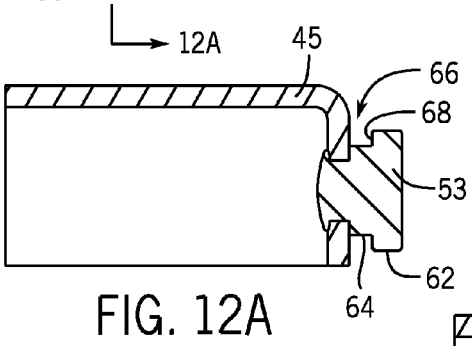
FIG. 12A is a sectional view of the shelf with the studs.
Figure 12B:
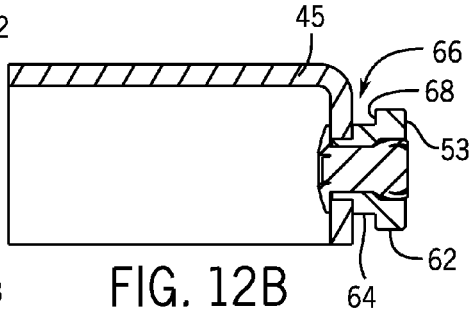
FIG. 12B is a sectional view of the shelf with the studs.
Figure 12C:
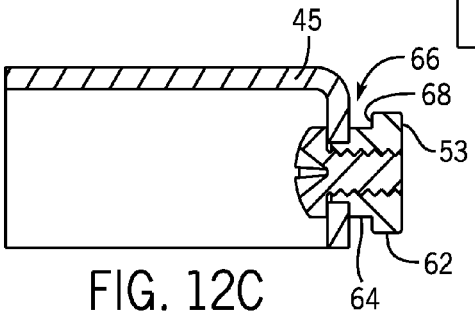
FIG. 12C is a sectional view of the shelf with the studs.
Figure 13:
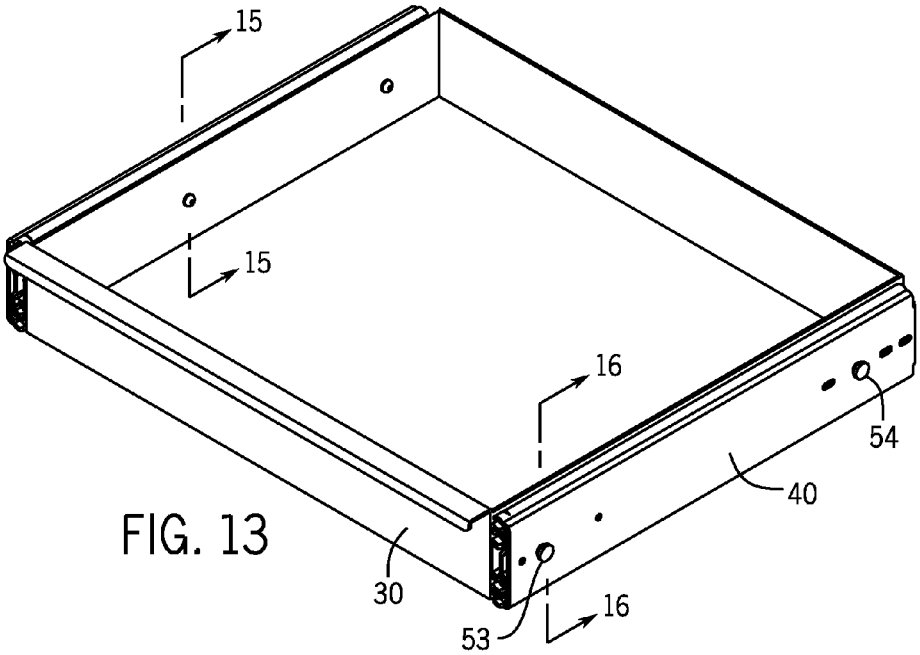
FIG. 13 is a perspective view of the drawer with the studs.
Figure 14:
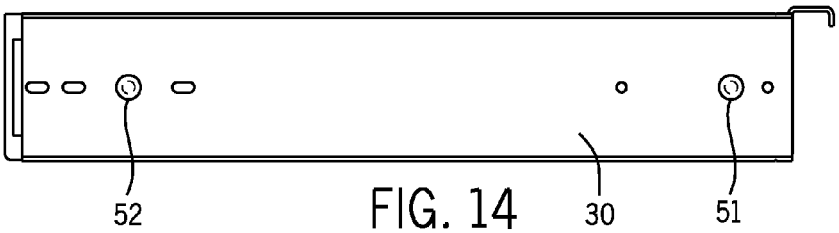
FIG. 14 is a side view of the drawer with the studs.
Figure 15:
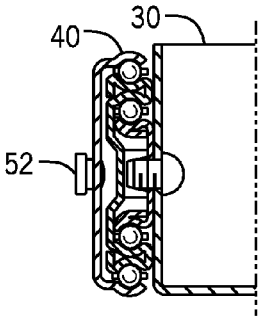
FIG. 15 is a sectional view of the drawer with the studs.
Figure 16:
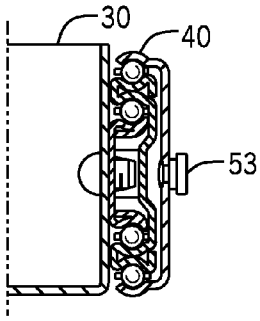
FIG. 16 is a sectional view of the drawer with the studs.
Figure 17:
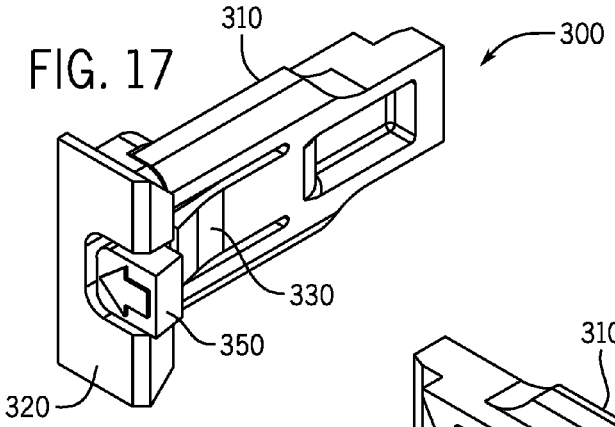
FIG. 17 is a perspective view of the plug.
Figure 18:
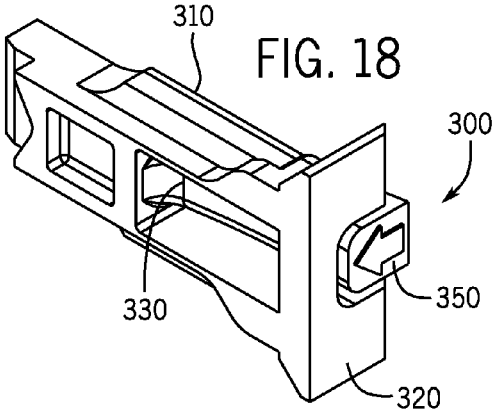
FIG. 18 is a perspective view of the plug.
Figure 20:
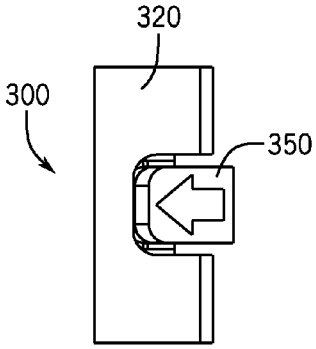
FIG. 20 is a front view of the plug.
Figure 19:
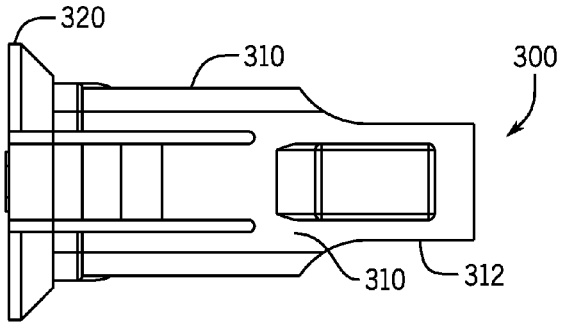
FIG. 19 is a side view of the plug.
Figure 21:
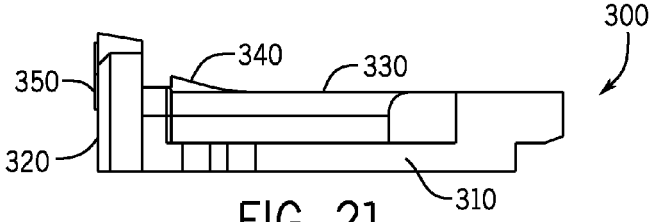
FIG. 21 is a side view of the plug.

Each of the studs 51, 52, 53, and 54 may include a similar construction. The studs 51, 52, 53, and 54 are generally affixed to the exterior surface of the drawer slides 40 or shelves 50. With reference to FIGS. 12A-12C, the studs 51, 52, 53, and 54 may be screwed, welded, riveted, or otherwise mechanically fastened or engaged to the drawer slides 40 or the shelves 45. The studs 51, 52, 53, and 54 include an extending portion 64 leading to a widened portion 62. The extending portion 64 is generally narrower than the widened portion 62. The widened portion 62 forms a head for the studs 51-54. A peripheral edge 70 is formed around an outside of the widened portion 62. A groove 66 is formed between a rear surface 68 of the widened portion 62 and the exterior surface of the drawer slides 40 or shelves 45. The groove 66 may be formed by the under-cut under the head of the studs 51-54. The groove 66 has a width slightly wider than a thickness of the supports 130 and 160 or at least the thickness of the walls of the supports 130 and 160 forming the channels 136, 137, 139, 166, 167, 169. The groove 66 may slide against a rim of the channels 136, 137, 139, 166, 167, 169.

The forward entry openings 134 and the rear entry openings 164 are sized just large enough to allow the studs 51-54 to enter. The forward entry openings 134 are mostly formed in the front wall 150 of the front support 130, and the rear entry openings 164 are mostly formed into the rear wall 170 of the rear support 160. As the studs 51-54 move past the forward entry openings 134 and the past the rear entry openings 164, the channels 136, 137, 166, 167, and 169 have a width smaller than the widened portion 62 of the studs 51-54. The studs 51-54 become trapped behind the walls 140 and 170. The studs 51-54 are held against the inner surfaces 142 and 172 of the supports 130 and 160, respectively. The extending portion 64 of the studs 51-54 extends through the walls 140 and 170 to engage the drawer 40 or the shelf 45. The rear surface 68 of the widened portion 62 slides or travels against or near the inner surfaces 142 and 172.

With reference to FIGS. 22A-F, the installation procedure of the shelf 45 to the front support 130 and the rear support 160 is shown. Although the installation of the shelf 45 is shown in FIGS. 22A-F, the installation of other drawers 30, drawer slides 40, bins, etc. will be similar. The shelf 45 includes the studs 53 and 54 on a right side of the shelf 45, and studs 51 and 52 (both not shown) on a left side of the shelf 45. The studs 52 and 54 are at rear side of the shelf 45, while the studs 51, 53 are at a front side of the shelf 45. In FIGS. 22A-F, only the right side of the shelf 45 is illustrated for clarity.

Figure 22A:
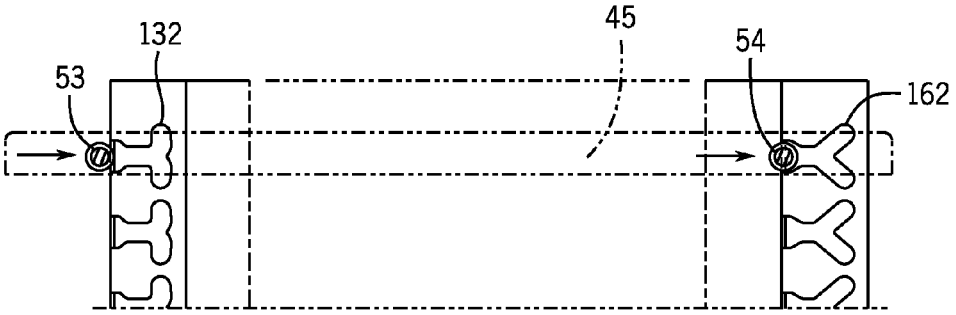
FIGS. 22A-22F are views of the installation of the studs to the supports.

With reference to FIG. 22A, the shelf 45 is positioned with the studs 51 and 53 at the forward entry openings 134 of the forward engaging openings 132. Similarly, the studs 52 and 54 are positioned at the rear entry openings 164 of the rear engaging openings 162.

Figure 22B:
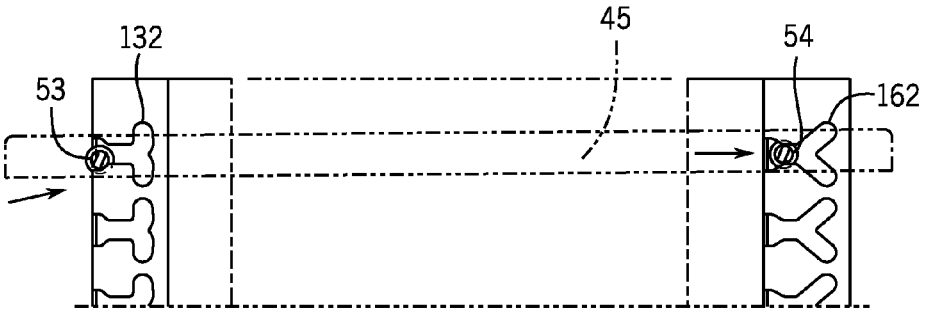

With reference to FIG. 22B, the shelf 45 moves laterally towards a rear position. The studs 52 and 54 enter the rear entry openings 164 before the studs 51 and 53 enter the forward entry openings 134. The forward entry openings 164 may include a ramping surface that allows the user to align the studs 52 and 54 at the rear entry openings 164, and to then draw the studs 51 and 53 up the ramping surface of the forward entry openings 164. This provides easier installation than requiring the user to align all four studs 51-54 with the entry openings 134 and 164.

Figure 22C:
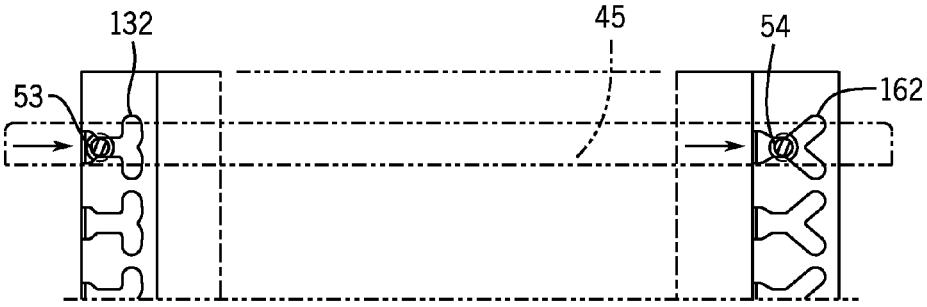

With reference to FIG. 22C, the shelf 45 continues to move laterally towards the rear position, the studs 52 and 54 enter the rear channels 166, and the studs 51 and 53 enter the forward channels 136.

Figure 22D:
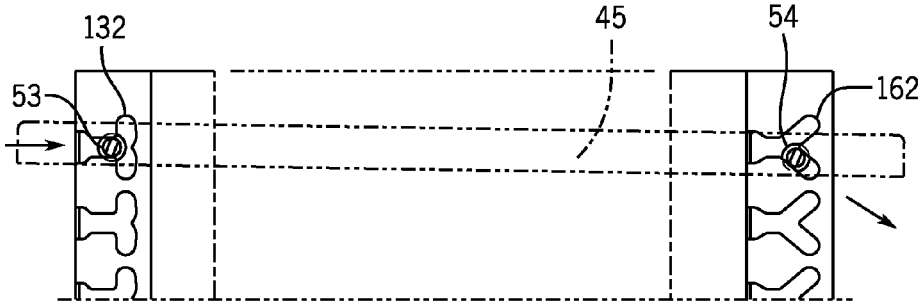

With reference to FIG. 22D, the shelf 45 continues to move laterally towards the rear position, and a rear portion of the shelf 45 begins angling downward. The studs 51 and 53 move through the forward channels 136, and the studs 52 and 54 move into the rear lower channels 167, and then move toward ends 168 of the lower channels 167.

Figure 22E:
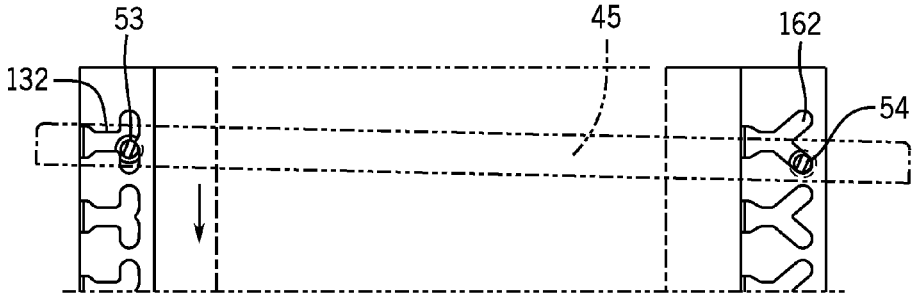

With reference to FIG. 22E, the studs 52 and 54 have reached the ends 168 of the rear lower channels 167 and are now seated in the ends 168. The studs 51 and 53 are over the forward lower channels 137.

Figure 22F:
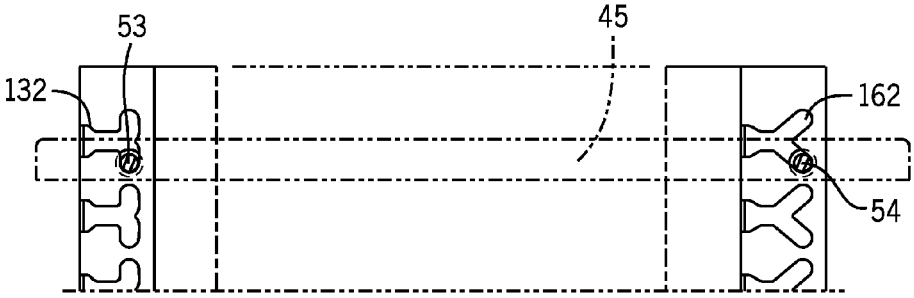

With reference to FIG. 22F, the front portion of the shelf 45 has moved in the downward direction. The studs 51 and 53 have moved through the forward lower channels 137 to the ends 138 of the forward lower channels 137. The studs 51 and 53 are now seated in the ends 138 of the forward lower channels 137. The studs 52 and 54 have remained seated in the ends 168 of the rear lower channels 167, but may have slightly rotated in the ends 168 of the rear lower channels 167 as the studs 51 and 53 moved downward through the forward lower channels 137.

The weight of the shelf 45 and the angles of the channels 137, 139, 167, and 166 helps to maintain the studs 51-54 seated in the ends 138 and 168 of their respective channels 137, 139, 167, and 166. The distance between the studs 53 and 54 is approximately the same as the distance between the ends 138 and 168. The distance between the studs 51 and 52 is approximately the same as the distance between the ends 138 and 168. This spatial relationship locks the studs 51-54 in the ends 138 and 168. Once the studs 51 and 53 are seated in the ends 138 of the forward lower channels 137 and the studs 52 and 54 are seated in the ends 168 of the rear lower channels 167, the shelf 45 is essentially locked in place. The studs 51 and 53 cannot move laterally due to the vertical walls of the forward lower channels 137. The studs 52 and 54 cannot move laterally or vertically due to the walls of the rear lower channels 167. The weight of the shelf 45 will generally hold the shelf 45 in place. As described below, one or more plugs 300 may block or lock one or more of the studs 51-54 into the forward engaging openings 132 and the rear engaging openings 162, respectively. The plug 300 may be utilized to prevent the studs 51 and 53 from moving upward, which essentially locks the shelf 45 in place.

Figure 23A:
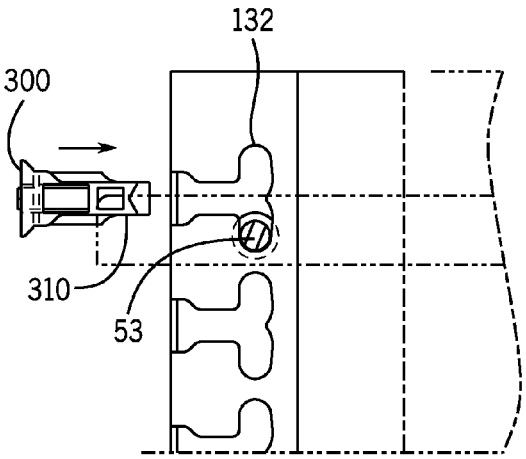
FIGS. 23A and 23B are side views of the plug installed in the supports.
Figure 23B:
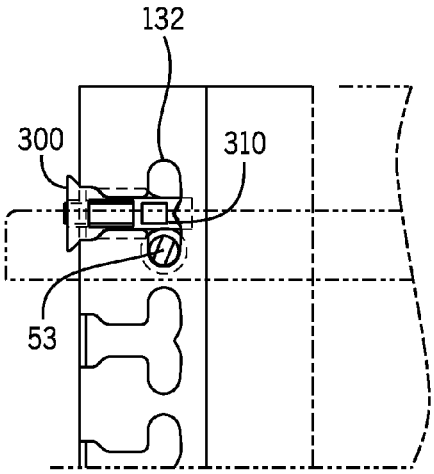
Figure 24:
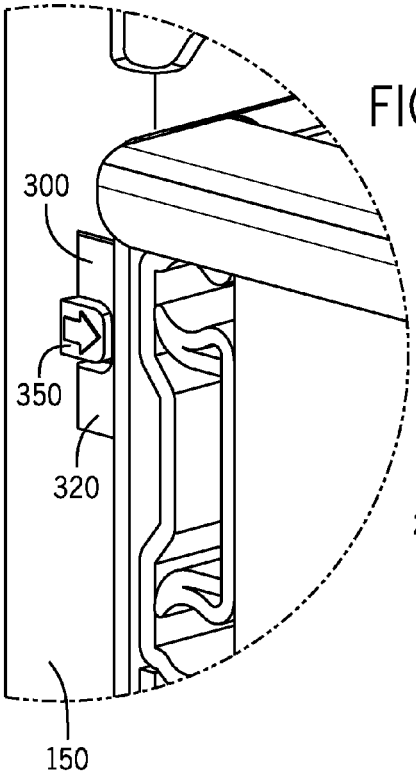
FIGS. 24 and 25 are side views of the plug installed in the supports.
Figure 25:
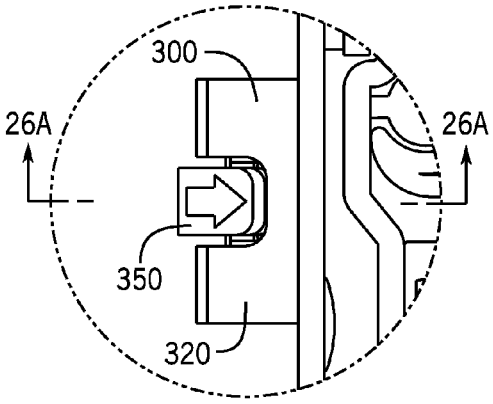
Figure 26A:
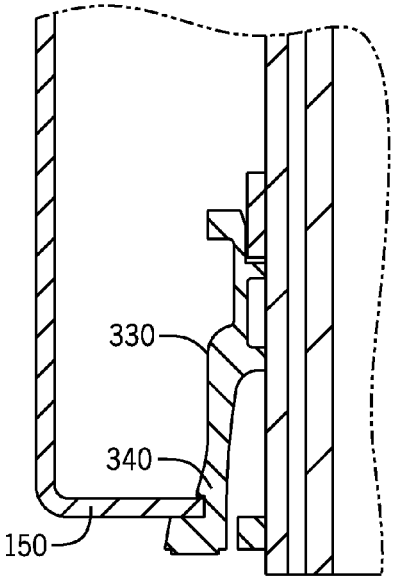
FIGS. 26A and 26B are sectional views of the catch of the plug engaging the supports
Figure 26B:
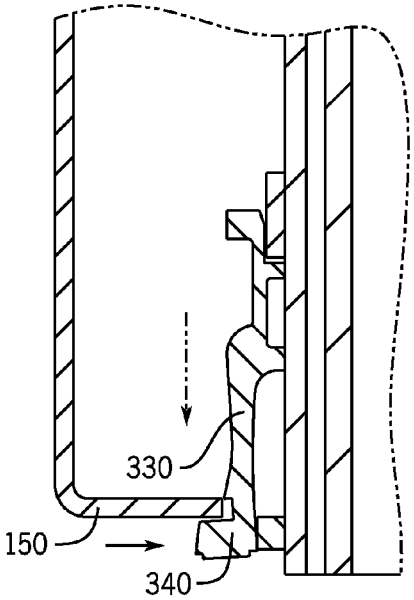

The plug 300 may be installed in the entry openings 134 and 164. The plug 300 is shown in detail in FIGS. 17-21. The plug 300 locks the studs 51, 52, 53, and 54 in position. As shown in FIGS. 23A and 23B, the plugs 300 block the studs 51, 52, 53, and 54 from moving or rotating upward. The plug 300 includes an insert portion 310 and a rim portion 320. A biasing member 330 urges a catch 340 to engage the support 130 or 160. A release 350 maybe pressed to disengage the catch 340 such that the plug 300 may be removed from the entry openings 134 and 164. A lower surface 312 of the insert portion 310 locks the studs 51-54 in their respective channels. For example, as shown in FIG. 23B, the stud 53 is blocked by the lower surface 312 and cannot move from the forward lower channel 137. This stabilizes the installation of the shelf 45, as the stud 53 cannot move upward or out of the forward lower channel 137. In other aspects, the plug 300 may be replaced with a lock or other positioner that prevent the upward movement of the studs 51-54. The lock or other positioner may be held in place via friction, detents, clips, biasing members, etc.

The universal panel 100 may be separated into a universal front support 110 and a universal rear support 120. In installing cabinets or shelving, the universal front support 110 may be attached to an interior of the cabinet at both front left and front right positions. Similarly, the universal rear support 120 may be attached to an interior of the cabinet at both rear left and rear right positions. Other supporting structures may be added to the universal front support 110 and the universal rear support 120 such that the universal front support 110 and the universal rear support 120 may be attached to walls.

Figure 10:
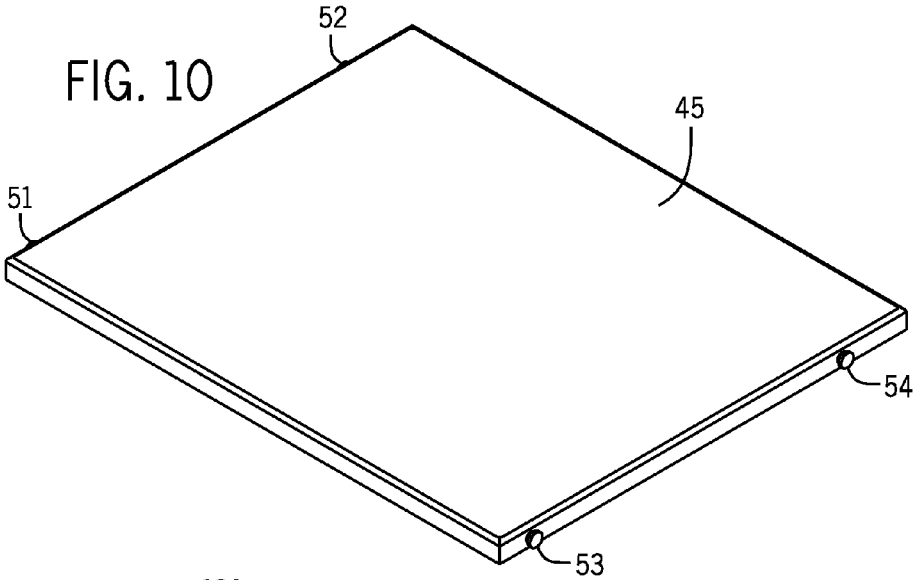
FIG. 10 is a perspective view of the shelf with the studs.
Figure 11:
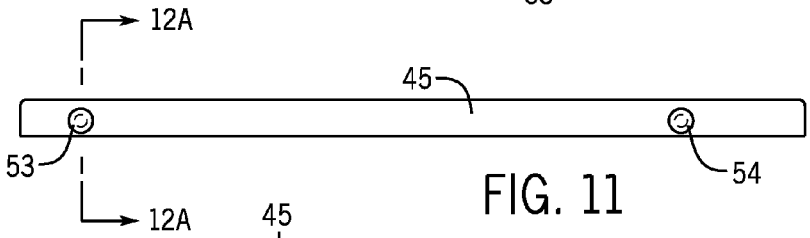
FIG. 11 is a side view of the shelf with the studs.

With reference to FIG. 10, the shelf 45 is shown removed from the cabinet 20. The shelf 45 includes the studs 51, 52, 53, and 54 positioned around a perimeter of the shelf 45. During installation of the shelf, the studs 51 and 53 are inserted into forward engaging openings 132, and the studs 52 and 54 are inserted into the rear engaging openings 162.

Figure 8:
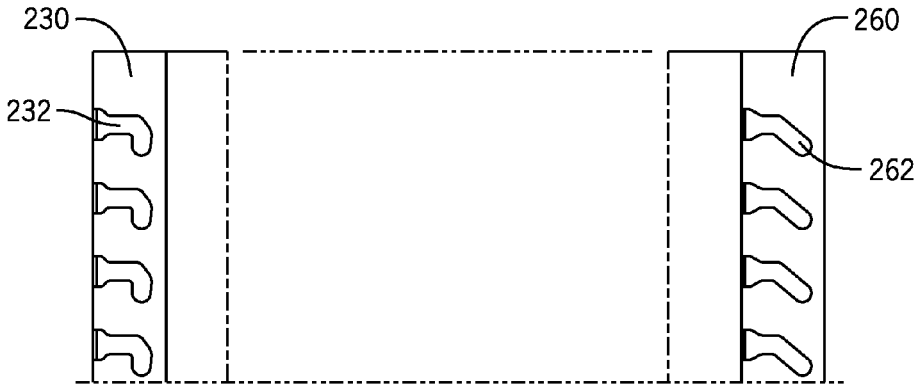
FIG. 8 is a side view of the front support and the rear support
Figure 9A:
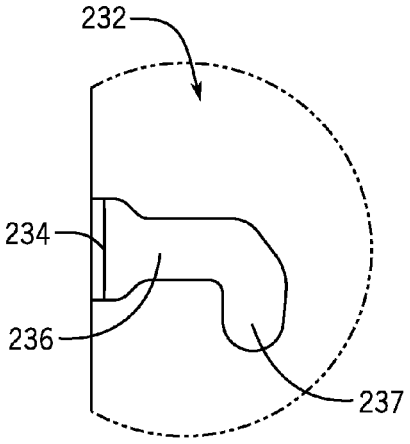
FIG. 9A is a view of the forward engaging opening of the front support
Figure 9B:
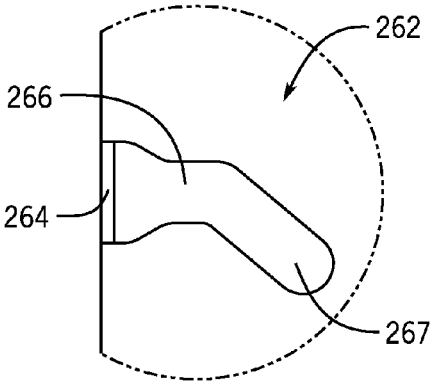
FIG. 9B is a view of the rear engaging opening of the rear support.

With reference to FIGS. 8 and 9A-B, supports are shown with side-specific engaging openings. A front support 230 has a plurality of forward engaging openings 232 spaced along its length. The forward engaging openings include a forward entry opening 234, which leads to a forward channel 236, which leads to a forward lower channel 237.

A rear support 260 has a plurality of rear engaging openings 262 spaced along its length. The rear engaging openings 262 include a rear entry opening 264 leading to a rear channel 266, which leads to a rear lower channel 267.

A left front support, left rear support, a right front support, and a right rear support may all be formed as individual pieces with the various engaging openings 132 and 162, as well as the engaging openings 232 and 262 described herein.

The various supports and panels described herein may be formed from metals, metal alloys, plastics, and other materials with sufficient strength. The various supports and panels described herein may be formed through extrusion or other conventional metal forming techniques. Plastic versions may be formed from molding and other conventional plastic forming techniques.

In other aspects, the mounting system 10 may use headless studs. The front support 130 and the rear support 230 may be installed in a manner where the channels 136, 137, 139, 166, 167, 169 maintain the headless studs without the need for headed studs.

In other aspects, a single universal panel 100 or one of the other supports 130, 160 may be installed flush against a wall or other flat surface. This provides a hanging system. For example, a cantilevered shelf or other hanging device may be fitted with at least two studs. The shelf or device may installed to the universal panel 100 or other support 130, 160 by seating the studs in the forward and rear engaging openings, and moving the shelf or device laterally such that the studs seat in the engaging openings.

Figure 27:
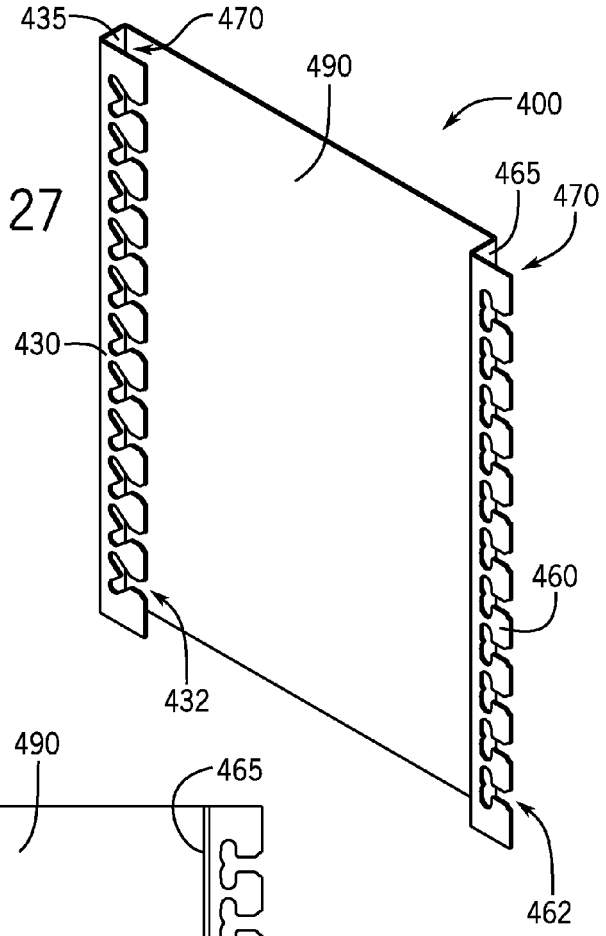
FIG. 27 is a perspective view of a universal panel with open edges.
Figure 28:
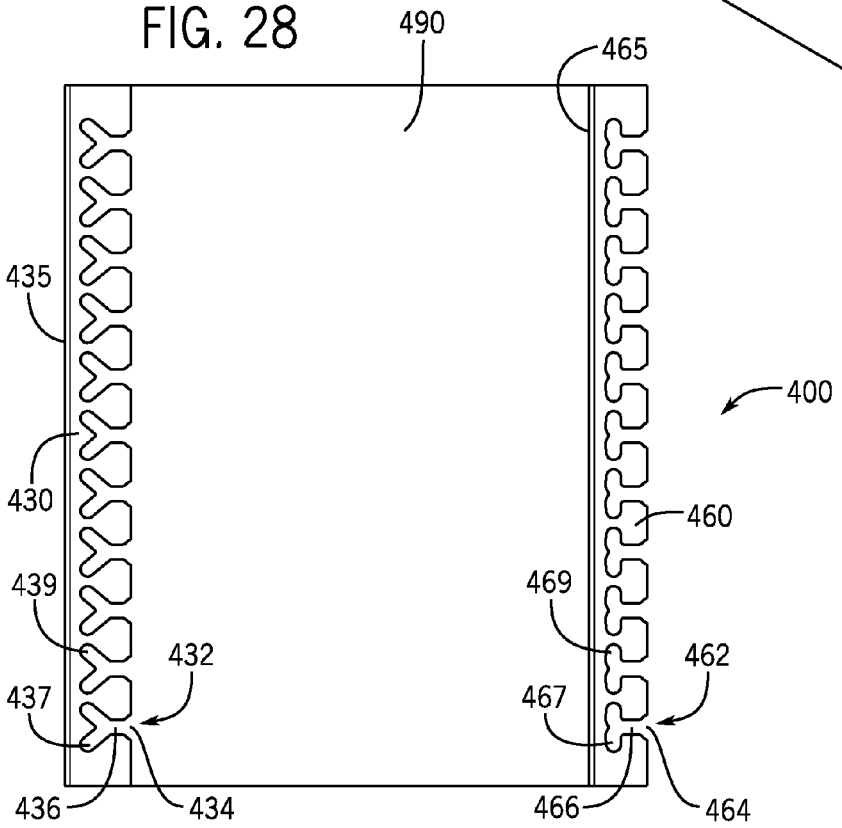
FIG. 28 is a front view of the universal panel with open edges.

With reference to FIGS. 27 and 28, a universal panel 400 is shown. The panel 400 may be used as the right and left holding members for shelves, bins, drawers, drawer-slides, etc. The universal panel 400 may be formed from a single piece of bent or molded material, which may reduce manufacturing costs.

Figure 2:
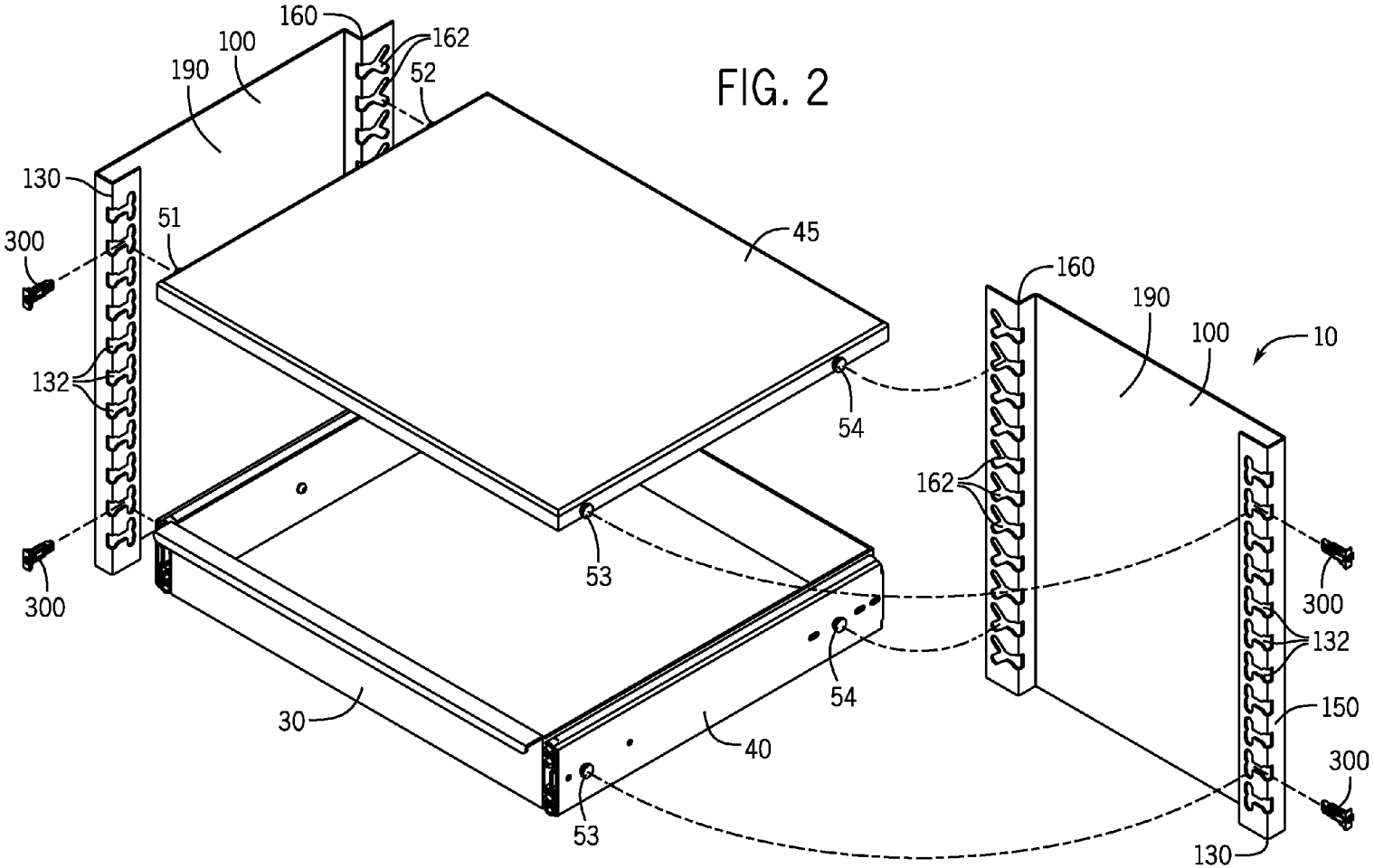
FIG. 2 is an exploded view of the shelf and the drawer using the mounting system.

The universal panel 400 will now be described with reference to shelving or cabinet assembly where a left panel 400 and a right panel 400 hold a shelf, such as the shelf 45 of FIGS. 1-2. The left panel 400 and the right panel 400 may have an identical construction, but in a flipped configuration. The shelf 45 may installed to the right panel 400 by seating the stud 54 in a rear engaging opening 432 and by seating the stud 53 in a forward engaging opening 462, and moving the shelf 45 in rearward manner, such that the studs 53, 54 seat in the engaging openings 432, 462. At the same time, studs 51, 52 are likewise similarly fitted into the left panel 400.

The panel 400 includes a rear support 430 and a forward support 460 integral with or attached to a backing 490. The backing 490 spans a distance between the rear support 430 and the forward support 460. The backing 490 may be mounted flush to the walls, cabinets, or other structures. The rear support 430 includes the rear engaging openings 432. The forward support 460 includes the forward engaging openings 462. The engaging openings 432 and 462 receive studs 53, 54, which are attached to the shelf 45. The studs 53, 54 removably engage to the engaging openings 432 and 462 of the right panel 400 similar to other aspects described herein.

A rear side wall 435 and a forward side wall 465 may bend or extend from the backing 490 of the panel 400 in order to create a space 470 behind the rear support 430 and the forward support 460. For example, the rear side wall 435 and the forward side wall 465 may form a generally perpendicular angle relative to the backing 490. In other aspects, the rear side wall 435 and the forward side wall 465 may be lengthened or shortened and the angle relative to the backing 490 may be reduced or increased. The space 470 behind the rear support 430 and the forward support 460 allows the heads of the studs 53, 54 to travel behind the rear support 430 and the forward support 460. The space 170 separates the rear support 430 and the forward support 460 from the backing 490 and from walls or other surfaces to which the panel 400 is attached.

During installation, the shelf 45 moves rearwardly. The stud 54 enters the rear engaging opening 432 and the stud 53 enters the forward engaging opening 462 of the right panel 400. The left panel 400 functions in same fashion. The rear engaging opening 432 includes an entry opening 434 leading to a central channel 436, which leads to a lower channel 437 and an upper channel 439. The lower channel 437 angles downward from the central channel 436, and the upper channel 439 angles upwards from the central channel 436. For example, the lower channel 437 may angle downward and away from the central channel 436 at an angle of approximately negative 45 degrees, and the upper channel 439 may angle upward and away from the central channel 436 at an angle of approximately positive 45 degree. The entry opening 434, the central channel 436, the lower channel 437, and the upper channel 439 generally pass through the entire width of the rear support 430.

The forward engaging opening 462 include an entry opening 464 leading to a central channel 466, which leads to a lower channel 467 and an upper channel 469. The lower channel 467 may be generally perpendicular to the central channel 466, and the upper channel 469 may be generally perpendicular to the central channel 466.

The entry opening 464, the central channel 466, the lower channel 467, and the upper channel 469 generally pass through the entire width of the forward side 460. In other aspects, the backing 490 may be reduced or separated, such that the rear support 430 and the forward support 460 are separate members.

The universal panel 400 may also be installed flush against a wall or other flat surface to provide a hanging system. For example, a cantilevered shelf or other hanging device may be fitted with at least two studs. The two studs are then inserted into engaging openings, and the device is moved laterally (for example, a right to left motion). In this arrangement, the device may extend generally perpendicular from the panel 400.

With reference to FIGS. 29 and 30, a universal panel 500 is shown. The panel 500 may be used as the right and left holding members for shelves, bins, drawers, drawer-slides, etc. having a non-headed stud, such as a peg, pin, or other protruding member. The spacing or distance between a left panel 500 and a right panel 500 prevents the non-headed stud from pulling out of the various channels. A shelf 545 may installed to the right panel 500 by seating a non-headed stud 551 in a rear engaging opening 532 of the right panel 500 and by seating a non-headed stud 552 in a rear engaging opening 532 of left panel 500, and moving the shelf or device rearwardly such that the studs 551, 552 seat in the engaging openings 532, while additional studs (not shown) seat in the engaging openings 562 of the forward sides 560. The panel 500 includes the rear side 530 and the forward side 560 integrally joined with or attached to a backing 590. In FIGS. 29 and 30, the rear side 530 and the forward side 560 are shown separated from the backing 590, but are attached during the manufacturing or installation process. The backing 590 spans a distance between the rear side 530 and the forward side 560. The rear side 530 includes the rear engaging opening 532. The forward side 560 includes the forward engaging opening 562. The engaging openings 532 receive the studs 551, 552, which are attached to the shelf 545, similar to other aspects described herein.

The rear engaging opening 532 includes an entry opening 534 leading to a central channel 536, which leads to a lower channel 537 and an upper channel 539. The lower channel 537 angles downward from the central channel 536, and the upper channel 539 angles upwards from the central channel 536. For example, the lower channel 537 may angle downward and away from the central channel 536 at an angle of approximately negative 45 degrees, and the upper channel 539 may angle upward and away from the central channel 566 at an angle of approximately positive 45 degree. The entry opening 534, the central channel, the lower channel 537, and the upper channel 539 are bored or formed into the rear side 530. The entry opening 534, the central channel 536, the lower channel 537, and the upper channel 539 may pass through the entire width of the rear side 530, in which case a back surface 531 of the rear side 530 is flush against the backing 590 or other support structure, such as a wall or cabinet surface. In other aspects, the entry opening 534, the central channel 536, the lower channel 537, and the upper channel 539 are bored or formed into only a portion of the depth of the rear side 530.

The forward engaging opening 562 include an entry opening 564 leading to a central channel 566, which leads to a lower channel 567 and an upper channel 569. The lower channel 567 may be generally perpendicular to the central channel 566, and the upper channel 569 may be generally perpendicular to the central channel 566. In other aspects, the entry opening 564, the central channel 566, the lower channel 567, and the upper channel 569 are bored or formed into only a portion of the depth of the forward side 560.

The entry opening 564, the central channel 566, the lower channel 567, and the upper channel 569 are bored or formed into the forward side 560. The entry opening 564, the central channel 566, the lower channel 567, and the upper channel 569 may pass through the entire width of the forward side 560, in which case a back surface 561 of the forward side 560 is flush against the backing 590 or other support structure, such as a wall or cabinet surface.

What is claimed is:

1. An adjustable mounting system, comprising:

a left front support comprising a first forward entry opening leading to a first forward channel and a first forward lower channel, the first forward lower channel having a generally vertical orientation;

a left rear support comprising a first rear entry opening leading to a first rear channel and a first rear lower channel, the first rear lower channel having an angled orientation;

a right front support comprising a second forward entry opening leading to a second forward channel and a second forward lower channel, the second forward lower channel having a generally vertical orientation;

a right rear support comprising a second rear entry opening leading to a second rear channel and a second rear lower channel, the second rear lower channel having an angled orientation;

a first stud configured to enter the first forward entry opening, a second stud configured to enter the first rear entry opening, a third stud configured to enter the second forward entry opening, and a fourth stud configured to enter the second rear entry opening; and, the first stud seated in the first forward lower channel, the second stud seated in the first rear lower channel, the third stud seated in the second forward lower channel, and the fourth stud seated in the second rear lower channel.

2. The adjustable mounting system according to claim 1, wherein the first stud is seated in an end of the first forward lower channel, the second stud is seated in an end of the first rear lower channel, the third stud is seated in an end of the second forward lower channel, the fourth stud is seated in an end of the second rear lower channel, wherein a distance between the ends of the first forward upper channel and the first forward lower channel is approximately the same as a distance between the first stud and the second stud, and wherein a distance between the ends of the second forward upper channel and the second forward lower channel is approximately the same as a distance between the third stud and the fourth stud.

3. The adjustable mounting system according to claim 1, wherein walls of the first rear lower channel and walls of the second rear lower channel prevent the second and fourth studs from moving, and walls of the first forward lower channel and the second forward lower channel prevent the first and third studs from moving laterally.

4. The adjustable mounting system according to claim 1, wherein walls of the first forward lower channel and the second forward lower channel have the generally vertical orientation, wherein walls of the first rear lower channel and walls of the second rear lower channel angle downward and away from the from the walls of the first forward lower channel and the second forward lower channel.

5. The adjustable mounting system according to claim 1, wherein walls of the first forward lower channel and the second forward lower channel have the generally vertical orientation, wherein walls of the first rear lower channel and walls of the second rear lower channel angle downward at approximately 45 degrees with respect to the walls of the first forward channel and the second forward channel.

6. The adjustable mounting system according to claim 1, wherein the left front support is integral with the left rear support via a first backing, and the right front support is integral with the right rear support via a second backing.

7. The adjustable mounting system according to claim 1, wherein the left front support is separate from the left rear support, and the right front support is separate from the right rear support.

8. The adjustable mounting system according to claim 1, wherein the studs are rigidly attached to a shelf, bin, drawer, or drawer-slide.

9. The adjustable mounting system according to claim 1, wherein the left front support comprises a plurality of forward engaging openings, the right front support comprises another plurality of forward engaging openings, the left rear support comprises a plurality of rear engaging openings, and the right rear support comprises another plurality of rear engaging openings.

10. The adjustable mounting system according to claim 1, wherein the entry openings are sized to receive the studs, and the studs are held by the supports.

11. The adjustable mounting system according to claim 1, wherein the studs comprise an extending portion leading to a widened portion, wherein the widened portions are capable of passing through the entry openings and the extending portions pass through the supports.

12. The adjustable mounting system according to claim 1, wherein a widened portion of the first stud is configured to enter the first forward entry opening, a widened portion of the second stud is configured to enter the first rear entry opening, a widened portion of the third stud is configured to enter the second forward entry opening, and a widened portion of the fourth stud is configured to enter the second rear entry opening; wherein an extending portion of the first stud is configured to slide to the first forward lower channel, wherein an extending portion of the second stud is configured to slide to the first rear lower channel, wherein an extending portion of the third stud is configured to slide to the second forward lower channel, and an extending portion of the fourth stud is configured to slide to the second rear lower channel.

13. The adjustable mounting system according to claim 1, wherein the studs are rigidly attached to a surface of a shelf, a bin, a drawer, or a drawer-slide, wherein a widened portion of the first stud is configured to enter the first forward entry opening, a widened portion of the second stud is configured to enter the first rear entry opening, a widened portion of the third stud is configured to enter the second forward entry opening, and a widened portion of the fourth stud is configured to enter the second rear entry opening; wherein an extending portion of the first stud is configured to pass through the first forward lower channel, wherein an extending portion of the second stud is configured to pass through the first rear lower channel, wherein an extending portion of the third stud is configured to pass through the second forward lower channel, and an extending portion of the fourth stud is configured to pass through the second rear lower channel.

14. The adjustable mounting system according to claim 1, wherein the entry openings have a larger dimension than the studs, and the channels have a smaller dimension than the studs.

15. The adjustable mounting system according to claim 1, wherein at least one plug is installed in the first forward entry opening or the second forward entry opening.

16. The adjustable mounting system according to claim 1, wherein at least one plug is installed in the entry openings to blocks upward movement of the studs, wherein the plug includes an insert portion with a biased catch member to engage the supports.

17. A cabinet comprising the mounting system according to claim 1, wherein the mounting system adjustably and removably can attach at least one of a shelf, a bin, a drawer, or a drawer-slide to the cabinet.

18. A cabinet comprising the mounting system according to claim 1.

19. A method of installing drawers, drawer slides, bins, or shelves, comprising:

providing a left front support comprising a first forward entry opening leading to a first forward channel and a first forward lower channel, the first forward lower channel having a generally vertical orientation;

providing a left rear support comprising a first rear entry opening leading to a first rear channel and a first rear lower channel, the first rear lower channel having an angled orientation;

providing a right front support comprising a second forward entry opening leading to a second forward channel and a second forward lower channel, and the second forward lower channel having a generally vertical orientation;

providing a right rear support comprising a second rear entry opening leading to a second rear channel and a second rear lower channel, and the second rear lower channel having an angled orientation;

providing at least one drawer, drawer slide, bin, or shelf with a first stud, a second stud, a third stud, and fourth stud affixed to the least one drawer, drawer slide, bin, or shelf;

inserting the first stud into the first forward entry opening;

inserting the second stud into the first rear entry opening;

inserting the third stud into the second forward entry opening;

inserting the fourth stud into the second rear entry opening;

seating the first stud in the first forward lower channel;

seating the second stud in the first rear lower channel;

seating the third stud in the second forward lower channel; and, seating the fourth stud in the second rear lower channel.

20. The method according to claim 19, further comprising:

sliding the first stud through the first forward channel to the first forward lower channel;

sliding the second stud in the first rear channel to the first rear lower channel;

sliding the third stud in the second forward channel to the second forward lower channel; and, sliding the fourth stud in the second rear channel to the second rear lower channel.

* * * * *